US010040668B2

(12) United States Patent
Barneman et al.

(10) Patent No.: US 10,040,668 B2
(45) Date of Patent: Aug. 7, 2018

(54) METHOD AND APPARATUS FOR ADJUSTING LANDING DOOR ROLLERS

(71) Applicants: Hakan Barneman, Solna (SE); Petri Pukkila, Lappila (FI)

(72) Inventors: Hakan Barneman, Solna (SE); Petri Pukkila, Lappila (FI)

(73) Assignee: Kone Corporation, Helsinki (FI)

( * ) Notice: Subject to any disclaimer, the term of this patent is extended or adjusted under 35 U.S.C. 154(b) by 191 days.

(21) Appl. No.: 14/814,807

(22) Filed: Jul. 31, 2015

(65) Prior Publication Data

US 2015/0336770 A1 Nov. 26, 2015

Related U.S. Application Data

(63) Continuation of application No. PCT/FI2013/050149, filed on Feb. 11, 2013.

(51) Int. Cl.
*B66B 13/12* (2006.01)

(52) U.S. Cl.
CPC ..... *B66B 13/12* (2013.01)

(58) Field of Classification Search
CPC ..... B66B 13/12; B66B 13/00; B66B 17/36
See application file for complete search history.

(56) References Cited

U.S. PATENT DOCUMENTS

| | | | | |
|---|---|---|---|---|
| 5,485,896 | A | 1/1996 | Kowalczyk et al. | |
| 9,004,229 | B2 * | 4/2015 | Lindberg | B66B 13/12 116/226 |
| 9,643,821 | B2 * | 5/2017 | Burutjis | B66B 13/12 |
| 2004/0007429 | A1 * | 1/2004 | Angst | B66B 13/143 187/317 |
| 2007/0295564 | A1 | 12/2007 | Someya | |
| 2012/0048657 | A1 * | 3/2012 | Christen | B66B 13/08 187/330 |
| 2012/0118219 | A1 | 5/2012 | Lindberg et al. | |
| 2017/0197805 | A1 * | 7/2017 | Keiser | B66B 5/0087 |

FOREIGN PATENT DOCUMENTS

| | | | |
|---|---|---|---|
| JP | H10114484 | A | 5/1998 |
| JP | 2001146375 | A | 5/2001 |
| JP | 2007176630 | A | 7/2007 |
| JP | 2013018559 | A | 1/2013 |
| WO | WO-2008078135 | A1 | 7/2008 |

OTHER PUBLICATIONS

Extended European Search Report dated Sep. 6, 2016 issued in corresponding European Application No. 13874709.2.
International Search Report PCT/ISA/210 for International Application No. PCT/FI2013/050149 dated Sep. 2, 2013.

* cited by examiner

*Primary Examiner* — William E Dondero
*Assistant Examiner* — Diem M Tran
(74) *Attorney, Agent, or Firm* — Harness, Dickey & Pierce, P.L.C.

(57) ABSTRACT

The invention relates to a method and apparatus for adjusting landing door rollers in an elevator comprising at least an elevator car having at least a car door, a door operating assembly and a landing door coupler with its two vanes, and the elevator comprising an elevator shaft equipped with a landing door at each landing level. For adjusting the landing door rollers the mutual horizontal distance of the vanes of the landing door coupler is copied mechanically into the location further up in the elevator car than the location of the vanes.

16 Claims, 7 Drawing Sheets

METHOD AND APPARATUS FOR ADJUSTING LANDING DOOR ROLLERS

Figure 1:
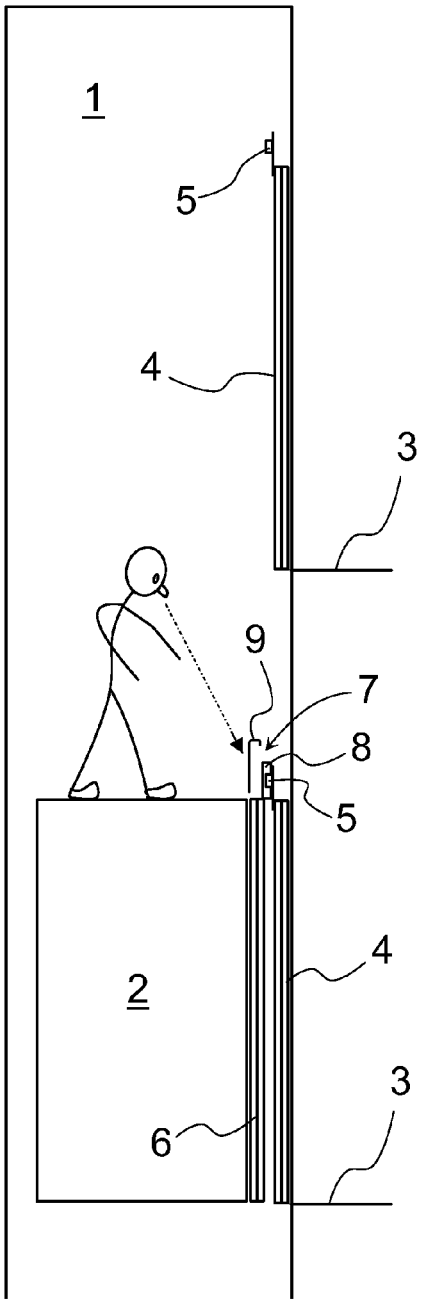

This application is a continuation of PCT International Application No. PCT/FI2013/050149 which has an International filing date of Feb. 11, 2013, the entire contents of which are incorporated herein by reference.

The present invention relates to a method as defined in the preamble of claim 1 and an apparatus as defined in the preamble of claim 9 for adjusting landing door rollers.

In ordinary elevators a door coupler that opens landing door locks and landing doors is usually situated in a door operator assembly of an elevator car door. The coupler is located just over the elevator car door and can be usually seen in an elevator shaft only from upwards in a narrow gap between the elevator car and the front wall of the elevator shaft. In order to be able to verify if the landing door rollers are correctly centered in relation to the coupler and that the clearances are sufficient a technician on the roof of the elevator car has to lean over the front edge of the car and try to see the landing rollers and the vanes of the coupler at the same time. In the narrow and dark gap this is not an easy task and it may easily cause a wrong alignment, which from its own part may cause Trapped passenger going out of services or even damages when the elevator is in a normal use. A difficult working position may also cause risks for the technician to be hurt. In addition difficult conditions and awkward working positions make the reliable adjusting of the landing door rollers according to prior art solutions extremely slow.

The object of the present invention is to eliminate the drawbacks described above and to achieve a reliable, cost efficient and easy-to-use method and apparatus for adjusting and controlling landing door rollers. Likewise the object of the present invention is to achieve a method and apparatus, which makes it possible to adjust landing door rollers reliably and fast in a good working position, and without a risk to be hurt resulting from an awkward working conditions and positions. The method for adjusting landing door rollers according to the invention is characterized by what is presented in the characterization part of claim 1. Correspondingly the apparatus for adjusting landing door rollers according to the invention is characterized by what is presented in the characterization part of claim 9. Other embodiments of the invention are characterized by what is presented in the other claims. Some inventive embodiments are also discussed in the descriptive section of the present application.

The invention can be thought to include among other things features as follows: for adjusting the landing door rollers or lock rollers the horizontal positions of the vanes of the landing door coupler of the elevator car indicating the mutual horizontal distance of the vanes is copied mechanically into the place further up in the elevator car than the location of the vanes. One such suitable place is, for example, the top track of the door operating assembly, though there may be also other suitable places in the upper part of the elevator car or above it. When copying the horizontal positions of the vanes, a gauge apparatus is used as an auxiliary tool. The gauge apparatus comprises at least two counter surfaces whose mutual horizontal distance is essentially the same as the mutual horizontal distance of the counter surfaces of the two essentially vertical vanes of the landing door coupler during the motion of the elevator car. The arrangement like this improves safety and makes the adjustment more reliable, easier and faster.

In addition the adjustment of the landing door rollers is performed with the gauge apparatus placed into its marked location and having the landing door rollers either inside or outside its counter surfaces that indicate the horizontal positions of the counter surfaces of the vanes. All the landing door rollers in the same shaft are adjusted by driving the elevator car so that at each floor the gauge apparatus are stopped about the same height level with the landing door rollers and the adjustment is performed from the elevator car roof. For the adjustment the gauge apparatus is fastened onto the top track with at least a magnet or screws, or with any other suitable fastening means. This arrangement facilitates a good and safe working position with an easy access to the landing door rollers, and the fastening of the gauge apparatus onto the top track guarantees the correct positioning.

Further an advantageous embodiment comprises the gauge apparatus that has two tabs that comprise alignment apertures for adjusting the landing door rollers in the depth direction of the elevator car. And in addition the bottom plate of the gauge apparatus comprises at least one marking slot to facilitate the marking of the correct place of the gauge apparatus in relation to the horizontal position of at least one vane. This arrangement makes it possible to adjust the landing door rollers easily, reliably and fast also in the depth direction of the elevator car. In addition the marking slots make the secure and fast positioning of the gauge assembly possible.

Preferably the horizontal vane distance is copied in the 1:1 scale. For landing door adjusting purposes it may be practical with certain landing door roller appliances to copy the vane distance to gauge wider or narrower than the actual vane distance is.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

The solution according to the invention has the advantage among other things that it saves a lot of time when adjusting landing door rollers. It also makes it possible to adjust landing door rollers reliably, and thanks to a good working position, without a risk to be hurt resulting from an awkward working conditions and positions. Thus the solution according to the invention improves working safety of maintenance persons. In addition one more useful advantage is that the ride comfort of elevators can be easily improved with the method and apparatus according to the invention.

Figure 2:
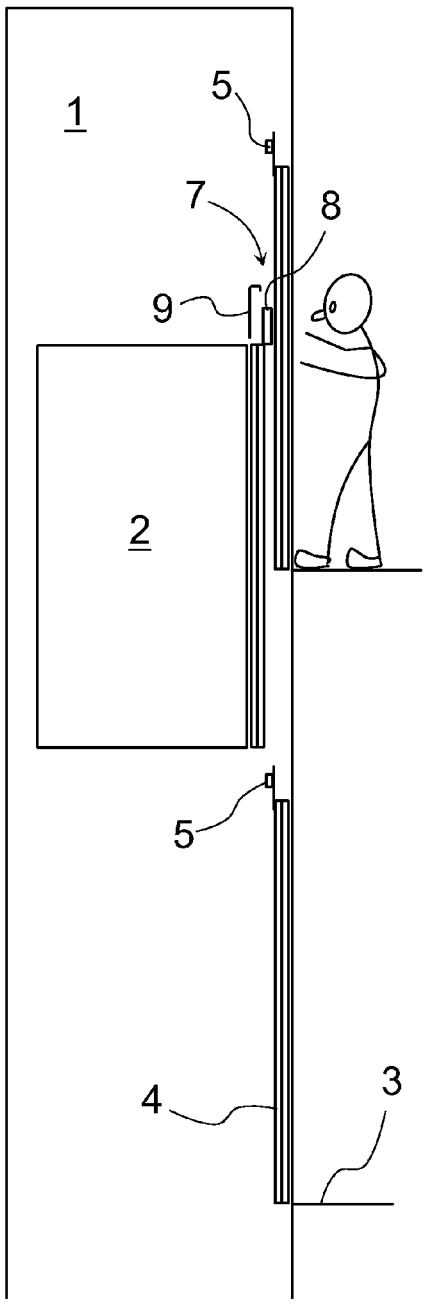
Figure 3:
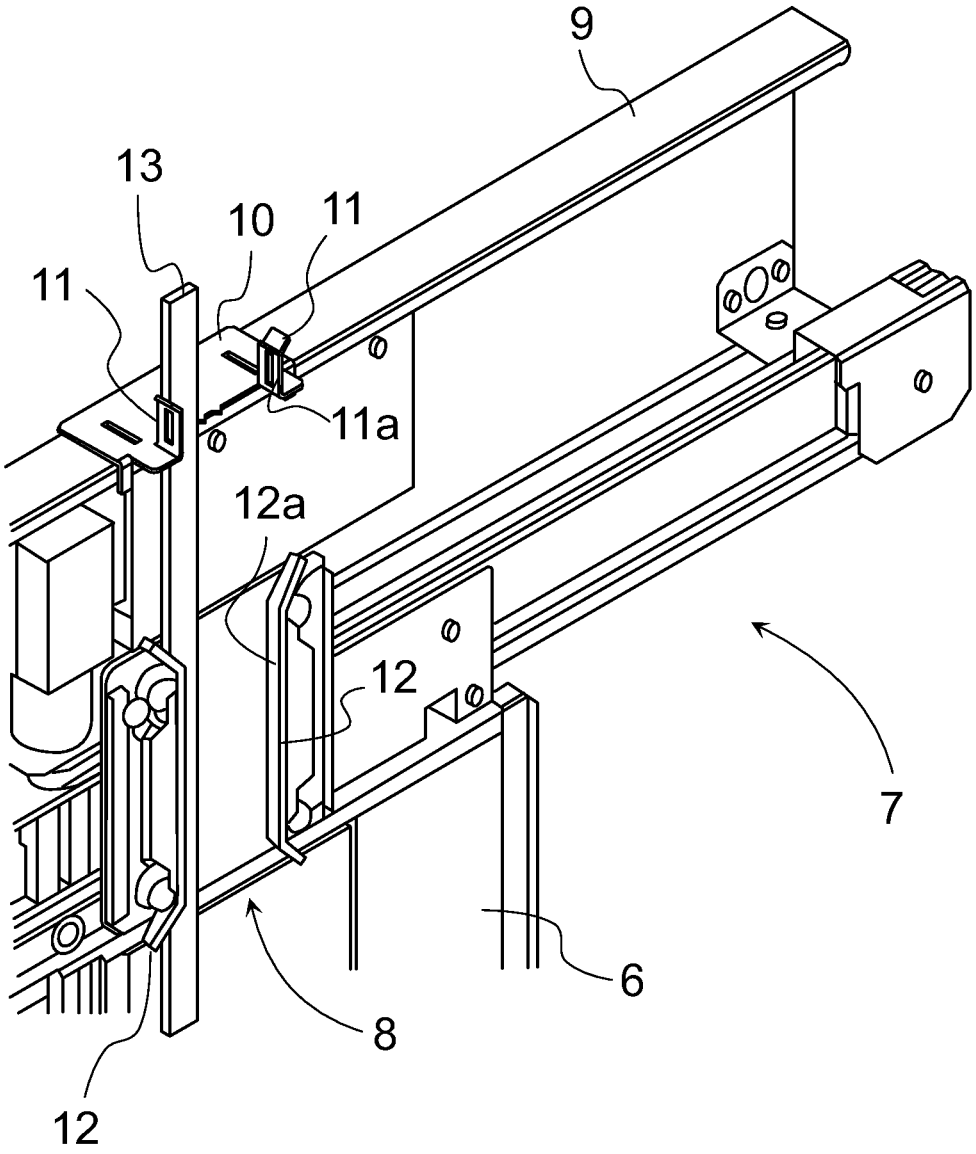
Figure 4:
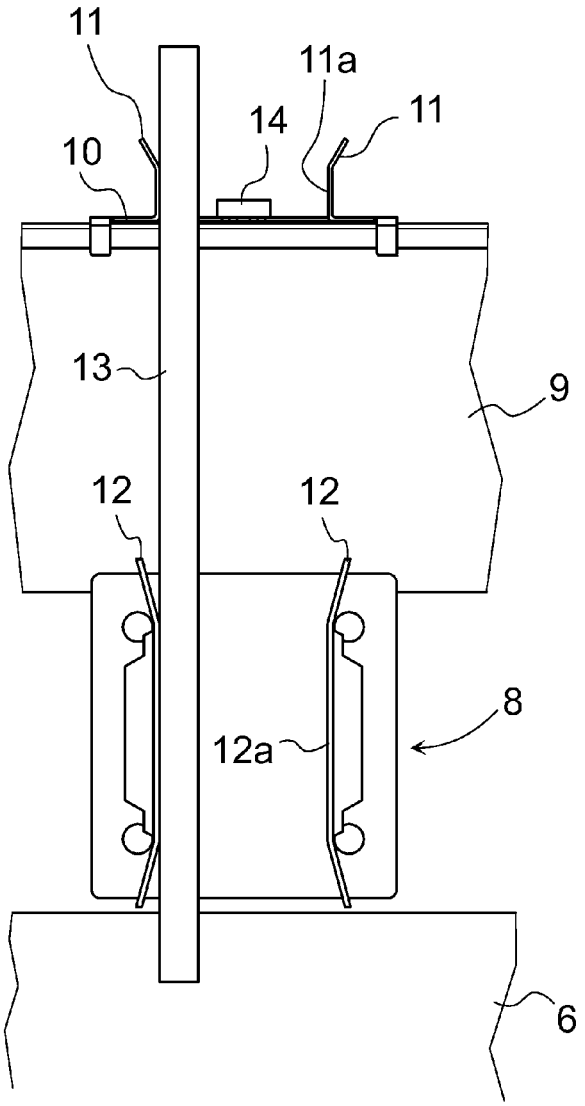
Figure 5:
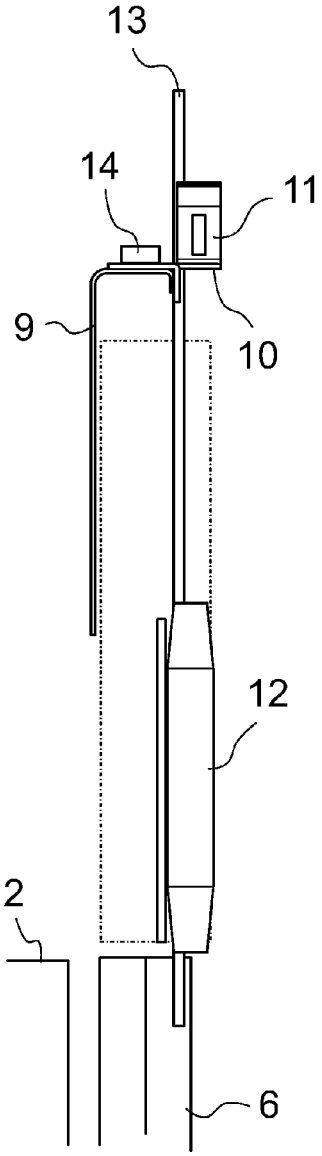
Figure 6:
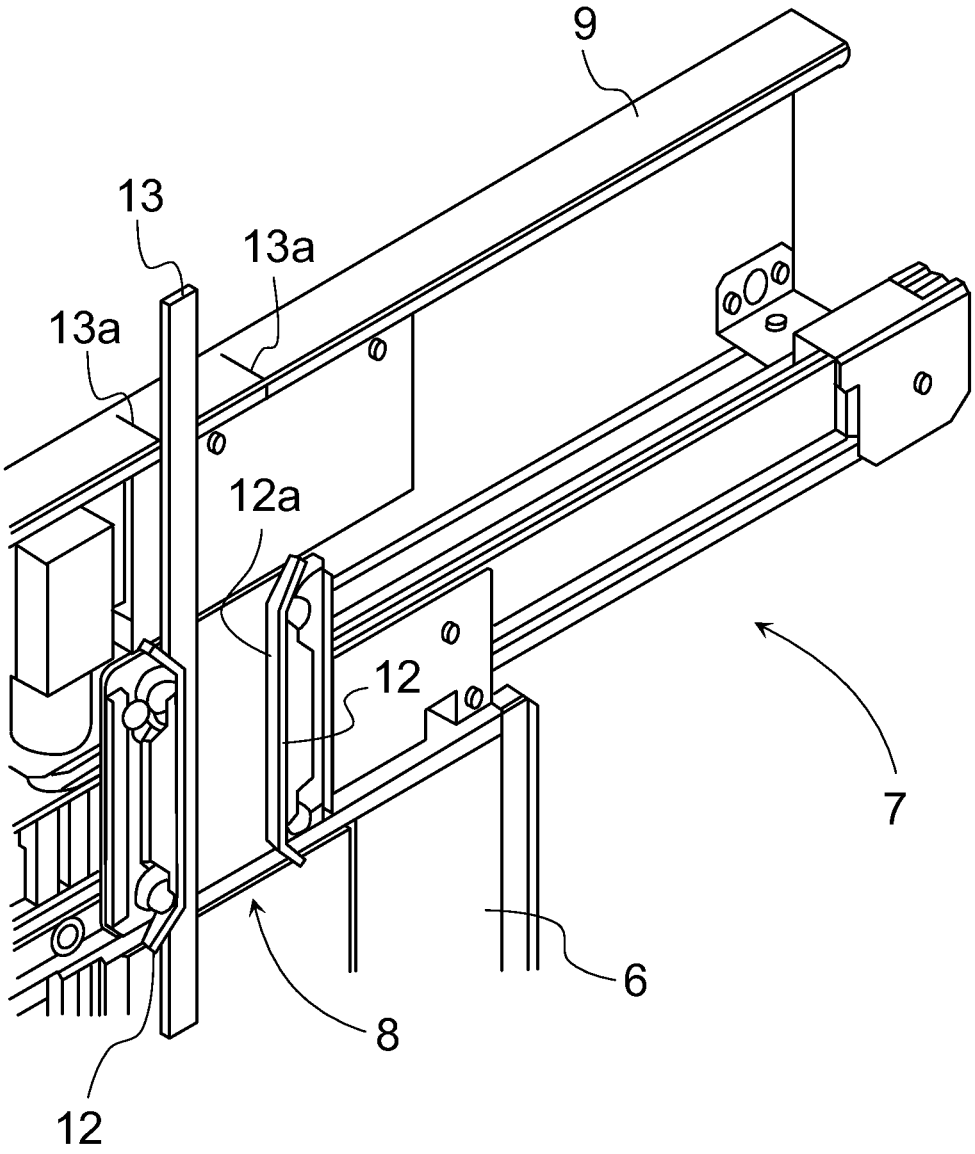
Figure 7:
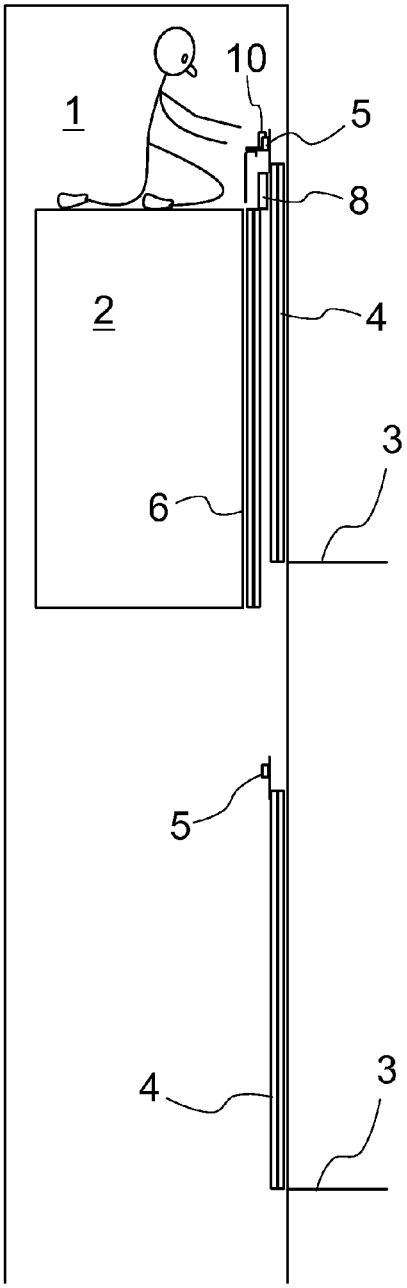
Figure 8:
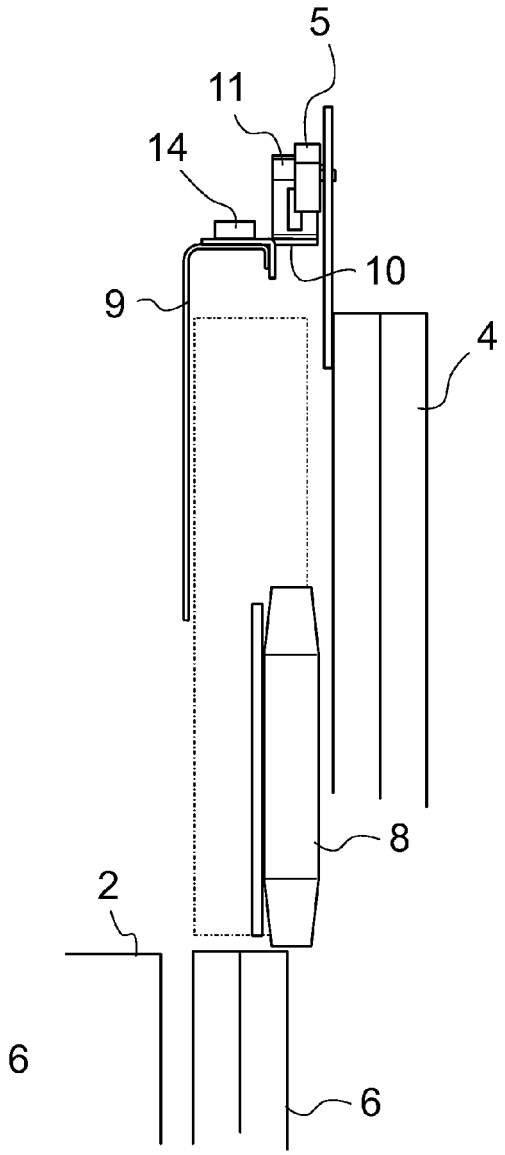
Figure 9:
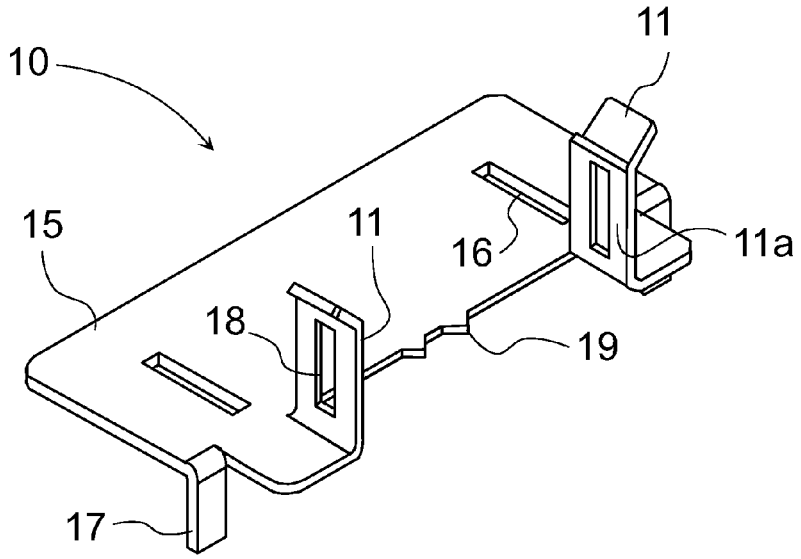
Figure 10:
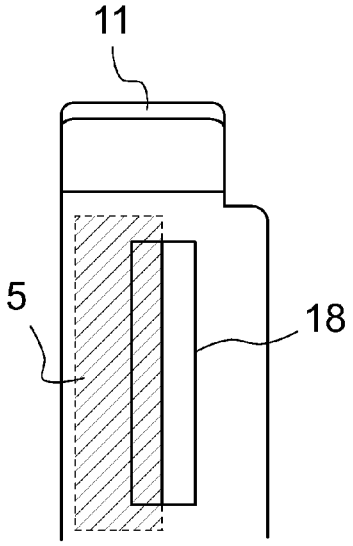
Figure 11:
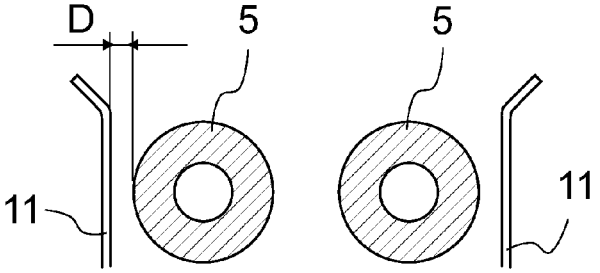
Figure 12:
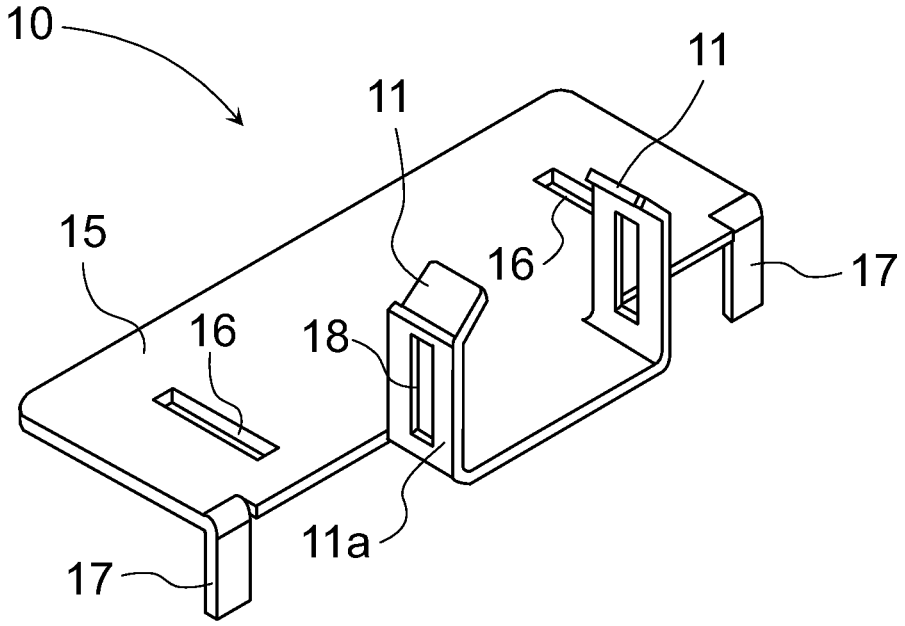
Figure 13:
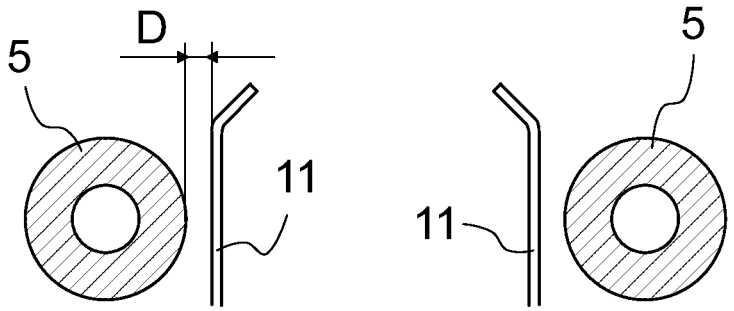

In the following, the invention will be described in detail by the aid of an example by referring to the attached simplified and diagrammatic drawings, wherein FIG. 1 presents in a simplified and diagrammatic side view an elevator car in an elevator shaft where the elevator car is at a landing level, FIG. 2 presents in a simplified and diagrammatic side view an elevator car in an elevator shaft where the elevator car is between two landing levels, FIG. 3 presents in an obliquely top view a part of a door operator assembly of an elevator car seen from the landing level side, and equipped with a gauge apparatus according to the invention FIG. 4 presents in a simplified and diagrammatic front view a part of the door operator assembly of an elevator car seen from the landing level side, and equipped with a gauge apparatus according to the invention, FIG. 5 presents in a simplified and diagrammatic side view a part of the door operator assembly of an elevator car equipped with a gauge apparatus according to the invention, FIG. 6 presents in an obliquely top view a part of a door operator assembly of an elevator car seen from the landing level side, and another method for copying the horizontal location of door coupler vanes into the top track of the door operating assembly, FIG. 7 presents in a simplified and diagrammatic side view an elevator car in an elevator shaft where the elevator car is at the upper end of the elevator shaft, and a technician is adjusting the uppermost landing door rollers, FIG. 8 presents in a simplified, diagrammatic and enlarged side view the arrangement for adjusting landing door rollers according to the invention, FIG. 9 presents in an obliquely top view a gauge apparatus according to the invention, FIG. 10 presents in a simplified and diagrammatic side view a part of the gauge apparatus according to the invention, a landing door roller being at a measuring location, FIG. 11 presents in a simplified and diagrammatic front view a part of the gauge apparatus according to the invention, landing door rollers being at a measuring location, FIG. 12 presents in an obliquely top view another gauge apparatus according to the invention, FIG. 13 presents in a simplified and diagrammatic front view a part of the gauge apparatus according to FIG. 12, landing door rollers being at a measuring location.

The main focus of the invention is to make it easier and more reliable to adjust landing door rollers of an elevator by copying the mutual horizontal distance of the guiding surfaces or counter surfaces of the door coupler vanes to a location where the adjustment of the landing door rollers can be easier done. Unless otherwise mentioned, the mutual horizontal distance of the counter surfaces here means the distance of the counter surfaces when the elevator car is moving in a normal drive. In order to copy the distance it is sufficient to copy at least a horizontal position of the counter surface of one vane.

In the example described below the lateral direction is defined to be the direction where the elevator doors are moving when they are opening and closing, and the depth direction is perpendicular to the lateral direction, i.e. the direction of depth of the elevator car.

FIGS. 1 and 2 present in a simplified and diagrammatic side view an elevator car 2 in an elevator shaft 1. In FIG. 1 the elevator car 2 is at a landing level 3 and in FIG. 2 the elevator car 2 is between two landing levels 3 and the landing door 4 is open so that the upper part of the elevator car 2 is seen from the upper landing level 3 through the door opening. Between the front wall of the elevator car 2 and the corresponding wall of the elevator shaft 1 there is a gap whose width is usually as narrow as possible but at least somewhat broader than the total width of the landing doors 4 at the landing levels 3 and the elevator car door 6, so that the elevator car 2 has enough space to travel up and down in the shaft 1. On top of the elevator car door 6 there is a door operating assembly 7 or door operator including at least means for opening and closing the car door 6, a landing door coupler 8 and a horizontal top track 9. The landing door coupler 8 is purposed to connect to landing door rollers 5 situated at each floor and fastened to the upper part of each landing door 4.

In the situation of FIG. 1 where the elevator car 2 is at a landing level 3, the landing door coupler 8 is in contact with the landing door rollers 5 or lock rollers. Depending on the structural solution of the coupler 8 the landing door rollers 5 are either between the two vanes of the coupler 8 or the vanes of the coupler 8 are between the two landing door rollers 5. In the example described the landing door rollers 5 are between the two vanes of the coupler 8. When a technician is on the roof of the elevator car 2 the door operating assembly 7 is so situated that the top track 9 and the door operator mechanism are between the landing door coupler 8 and the technician so that he or she has neither direct visual connection nor direct access to the landing door rollers 5. In this case the technician has to lean over the upper edge of the door operating assembly 7 in order to see the landing door rollers 5. However, the wall of the elevator shaft 1 is so close that adjusting the landing door rollers 5 is very difficult. And usually they cannot be adjusted just when they are in contact with the vanes of the coupler 8, thus the rollers 5 have to be sufficiently apart from the vanes of the coupler 8, either above or below the vanes. That makes the adjustment even more difficult.

In the situation of FIG. 2 the elevator car 2 is between two landing levels 3 so that the door operating assembly 7 of the elevator car 2 is vertically about in the middle of the landing door opening of the uppermost floor. When the landing door 4 has been opened, for example with a service key, the landing door coupler 8 of the elevator car 2 is easily seen from the uppermost landing level 3. But now the landing door rollers 5 are too far either above or below, and it is impossible to adjust them from the landing level 3.

The present invention brings help to this problem. FIGS. 3-5 show the door operator assembly 7 of the elevator car 2 equipped with a separate gauge apparatus 10 according to the invention. The gauge apparatus 10 has two essentially parallel tabs 11 each equipped with an essentially vertical counter surface 11*a*. The mutual horizontal distance of the counter surfaces 11*a* is essentially the same as the mutual horizontal distance of the counter surfaces 12*a* of the two essentially vertical vanes 12 of the landing door coupler 8 during the motion of the elevator car 2.

The gauge apparatus 10 is placed on top of the top track 9 and positioned in its location for example so that the counter surface 11*a* of the left-hand tab 11 is in the lateral direction or laterally in the same vertical line with the counter surface 12*a* of the left-hand vane 12 of the landing door coupler 8, and the counter surface 11*a* of the right-hand tab 11 is laterally in the same vertical line with the counter surface 12*a* of the right-hand vane 12 of the landing door coupler 8. The positioning is done for instance with a straight ruler 13. In this way the horizontal positions of the counter surfaces 12*a* of the vanes 12 are copied mechanically further away from the vanes 12, in this case upwards, to the place where the adjustment of the landing door rollers 5 is easy to perform.

As seen in FIG. 5 the tabs 11 of the gauge apparatus 10 extend in the depth direction outside from the floor side edge of the top track 9 so that they are in the depth direction essentially about the same vertical line with the vanes 12 of the landing door coupler 8. So the landing door rollers 5 that are placed between the vanes 12 when the elevator car 2 is at the landing level 3 are placed also between the tabs 11 when the elevator car 2 is at the height where the tabs 11 are at the same height as the landing door rollers 5. The gauge apparatus 10 is fastened onto the top track 9 for instance with a powerful magnet 14, or with screws or other suitable fastening means.

FIG. 6 presents in an obliquely top view a part of a door operator assembly of an elevator car seen from the landing level side. In this case the gauge apparatus 10 is not used yet in the phase when the horizontal location of the door coupler vanes 12 are copied with the ruler 13 into the top track 9 of the door operating assembly 7. Using the ruler 13 in a vertical position horizontal locations of the fully opened door coupler vanes 12 are copied into the top track 9 and marked onto the top track 9 with marking lines 13*a*. The gauge apparatus 10 is placed later just before adjusting the landing door rollers 5 onto the top track 9 according to the marking lines 13*a*.

FIG. 7 presents in a simplified and diagrammatic side view the elevator car 2 at the upper end of the elevator shaft 1 where a technician is on the roof of the elevator car 2 adjusting the uppermost landing door rollers 5. Now the rollers 5 are between the tabs 11 of the gauge apparatus 10 and the adjustment of the rollers 5 is easy to perform.

FIG. 8 presents the situation of FIG. 7 in a simplified, diagrammatic and enlarged side view. For the sake of clarity one of the tabs 11 in front of the rollers 5 has been removed from the figure. Also some components of the door operator assembly 7 have been removed. The space for the door operator mechanism is marked with a dot-and-dash line.

FIG. 9 presents in a more precise view the gauge apparatus 10 according to the invention. The gauge apparatus 10 has at least a bottom plate 15, one or more marking slots 16 in the bottom plate 15, alignment bendings 17 in each front corner, two essentially vertically oriented tabs 11 perpendicular to the plane of the bottom plate 15, alignment apertures 18 in each tab 11, and two adjusting tips 19 pointing outwards from the bottom plate 15. The gauge apparatus 10 is made of metal or other suitable material. When made of metal it can be made of one metal plate with a pressing machine having cutting, punching and bending tools. The bottom plate 15 forms a support for the other elements of the gauge apparatus 10. The tabs 11 have counter surfaces 11*a* towards each other, and the mutual horizontal distance between the counter surfaces 11*a* is larger than the mutual horizontal distance of the landing door rollers 5. The marking slots 16 serve as help when marking the locations of the vanes 12 onto the top track 9. In this example the form of the marking slots 16 is rectangular but it can also be of different form, the form can be for instance a plus sign. The two alignment bendings 17 keep the gauge apparatus 10 in a correct orientation at the front edge of the top track 9, and the alignment apertures 18 help adjusting the rollers 5 in the depth direction.

FIG. 10 presents the tab 11 of the gauge apparatus 10 in a side view. The alignment aperture 18 in the tab 11 is situated so that when the landing door roller 5 is in the correct position in the depth direction the outer end surface of the roller 5 is horizontally essentially in the middle of the aperture 18 as is shown in FIG. 10, or at least at the area of the aperture 18.

FIG. 11 presents two landing door rollers 5 between the tabs 11 of the gauge apparatus 10 seen for instance from the elevator car 2 roof. The horizontal clearance D between the tab 11 and the landing door roller 5 can be neither too small nor too large. The clearance D is set to the required operating tolerance and clearances required to be verified between the landing door roller 5 and the vanes 12 of the coupler, are for instance between 0, 1 to 5 mm, suitably for instance about 3 mm.

FIG. 12 presents in a more precise view another embodiment of the gauge apparatus 10 according to the invention. The gauge apparatus 10 and its elements are otherwise similar to the gauge apparatus 10 according to FIG. 9 but the orientation of the two tabs 11 differs from the orientation of the tabs of the gauge apparatus 10 according to FIG. 9. The tabs 11 themselves are similar of their structure but instead of having the counter surfaces 11*a* towards each other they are now facing away from each other. And the mutual horizontal distance between the counter surfaces 11*a* is smaller than the mutual horizontal distance of the landing door rollers 5.

When using the solution according to FIG. 3 the mutual distance of the marking slots 16 is not important and it can vary. Whereas when using the solution according to FIG. 6 where the gauge apparatus 10 is not used during the copy phase of the horizontal position of the door coupler vanes 12 the mutual distance of the marking slots 16 are essentially the same as the mutual distance of the counter surfaces 12*a* of the vanes 12 in their opened positions at a landing level.

FIG. 13 presents the tabs 11 of the gauge apparatus 10 between two landing door rollers 5 seen for instance from the elevator car 2 roof. The horizontal clearance D between the tab 11 and the landing door roller 5 is essentially the same as in the solution according to FIG. 11. The clearance D can be neither too small nor too large, and it is for instance between 0, 1 to 5 mm, suitably for instance about 3 mm.

The adjustment of the landing door rollers 5 is performed according to the method of the invention for example as follows: At first the elevator car 2 is positioned so that the technician has access to the car roof and to the door operating assembly 7 from the landing level 3, for instance from the topmost landing level when the landing door 4 has been opened for instance with a service key. Then the vertical line indicating the horizontal position of the counter surface 12*a* for instance of the left-hand vane 12 is copied upwards to the top track 9 for instance by pressing the left-hand edge of the straight ruler 13 in a vertical position against the counter surface 12*a* of the left-hand vane 12 and keeping the gauge apparatus 10 on top of the top track 9, and positioning the counter surface 11*a* of the left-hand tab 11 against the same left-hand edge of the straight ruler 13. When the counter surface 12*a* and the counter surface 11*a* are in the same vertical line the position of the gauge apparatus 10 is marked on top of the top track 9 for instance through the marking slots 16. When the marking is done the gauge apparatus 10 can be removed.

Another method for adjusting the landing door rollers 5 according to the invention is for example as follows: At first the elevator car 2 is positioned so that the technician has access to the car roof and to the door operating assembly 7 from the landing level 3, for instance from the topmost landing level when the landing door 4 has been opened for instance with a service key. Then the landing door coupler 8 is driven manually fully open and after that the vertical line indicating the horizontal position of the counter surface 12*a* for instance of the left-hand vane 12 is copied upwards to the top track 9 for instance by pressing the left-hand edge of the straight ruler 13 in a vertical position against the counter surface 12*a* of the left-hand vane 12 and drawing the marking line 13*a* onto the top track 9 according to the left-hand edge of the ruler 13. The same can be done with the right-hand vane 12.

When the markings 13*a* indicating the correct position of the gauge apparatus 10 have been made by one way or another, the elevator car 2 is driven to the topmost landing level using an inspection drive mode. The elevator car 2 is stopped when the landing door rollers 5 are just above the top track 9. After that the technician on the roof of the elevator car 2 positions the gauge apparatus 10 onto top of the top track 9 according to the markings 13*a* done and fastens the gauge apparatus 10 into its correct location for instance with a magnet 14 or using another suitable fastening means. Now the landing door rollers 5 are between the tabs 11 of the gauge apparatus 10 according to FIG. 11, or the tabs 11 of the gauge apparatus 10 are between the landing door rollers 5 according to FIG. 13 depending on the structure of the elevator door operating assembly 7 and the gauge apparatus 10.

Now the access to the landing door rollers 5 is easy and their position in relation to the counter surfaces 11*a* of the tabs 11 indicating the horizontal positions of the counter surfaces 12*a* of the vanes 12 is easy, fast and reliable to adjust. The positions of the rollers 5 is checked and adjusted both in the lateral direction comparing the position of the rollers 5 to the counter surfaces 11*a* of the tabs 11, and in the depth direction adjusting the outer end surface of the rollers 5 horizontally essentially in the middle of the apertures 18 as is shown in FIG. 10.

When the first adjustment has been done at the topmost landing level 3 the elevator car 2 is driven to the next landing level 3 downwards without moving the gauge apparatus 10, and the adjustment of the landing door rollers 5 is done there again. Doing this way all the landing door rollers 5 in the same shaft 1 are adjusted using the gauge apparatus 10, and after the adjustment the gauge apparatus 10 is removed.

It is obvious to the person skilled in the art that the invention is not restricted to the example described above but that it may be varied within the scope of the claims presented below. Thus, for example, depending on the structure of the elevator car the element to which the horizontal position of the vanes is copied can also be something else than the top track.

It is also obvious to the person skilled in the art that the gauge apparatus is not necessarily a separate tool but it can also be integrated with the top track of the door operating assembly or with another suitable location in the elevator car.

Yet, it is obvious to the person skilled in the art that the copying of the mutual horizontal distance of the vanes of the landing door coupler can be done also in a different way as mentioned above. Instead of copying the vertical line indicating the horizontal position of the vane directly to the gauge apparatus that is placed onto the top track the horizontal position of the vane can be copied directly onto the top track and the position can be marked directly on the top track. Then the gauge apparatus can be placed later to its correct position onto the top track according to the markings done beforehand.

The invention claimed is:

1. A method of adjusting landing door rollers in an elevator, the elevator including at least an elevator car and an elevator shaft equipped with a landing door at each landing level, the elevator car including at least a car door, a door operating assembly and a landing door coupler with vanes having counter surfaces separated by a first horizontal distance, the method comprising:

adjusting the landing door rollers by copying, using a gauge apparatus, a horizontal position of the vanes of the landing door coupler from a first location into a second location further up in the elevator car than the first location of the vanes, the gauge apparatus having counter surfaces having a second horizontal distance therebetween equal to the first horizontal distance of the counter surfaces of the vanes during motion of the elevator car.

2. The method according to claim 1, wherein before copying the horizontal position of the vanes the gauge apparatus is placed onto a top track of the door operating assembly.

3. The method according to claim 1, wherein the vanes are fully opened, the horizontal position of the fully opened vanes of the landing door coupler is copied into a top track of the door operating assembly and marked into the top track as markings, and the method further comprises:

placing the gauge apparatus onto the top track according to the markings done into the top track before adjusting the landing door rollers.

4. The method according to claim 1, wherein the copying of the horizontal position of the vanes is done from a landing level side of the landing door, when the door operating assembly of the elevator car is situated above a floor level of a same one of the landing levels.

5. The method according to claim 1 above, wherein the adjusting the landing door rollers is performed with the gauge apparatus placed into its marked location and having the landing door rollers either inside or outside the counter surfaces of the gauge apparatus that indicate the horizontal position of the counter surfaces of the vanes.

6. The method according to claim 1 above, wherein all the landing door rollers in a same elevator shaft are adjusted by driving the elevator car so that, at each floor, the gauge apparatus is stopped about a same height level with the landing door rollers and the landing door rollers are adjusted from a roof of the elevator car.

7. The method according to claim 6, wherein the adjusting includes fastening the gauge apparatus onto a top track of the door operating assembly with fastening means.

8. A gauge apparatus configured to adjust landing door rollers according to counter surfaces of vanes of a landing door coupler of an elevator car, the elevator car including at least a car door, a door operating assembly and the landing door coupler with the vanes, the gauge apparatus comprising:

at least a bottom plate placable on a horizontal plane in the elevator car; and at least two counter surfaces whose mutual horizontal distance is same as a mutual horizontal distance of the counter surfaces of the vanes of the landing door coupler at least during motion of the elevator car, the gauge apparatus configured to copy a horizontal position of the vanes of the landing door coupler from a first location into a second location further up in the elevator car than the first location of the vanes.

9. The gauge apparatus according to claim 8, wherein each counter surface of the gauge apparatus is in a tab that is perpendicular to a plane of the bottom plate of the gauge apparatus.

10. The gauge apparatus according to claim 9, wherein the tab comprises:

an alignment aperture configured to adjust the landing door rollers in a depth direction of the elevator car.

11. The gauge apparatus according to claim 8, wherein the bottom plate comprises at least one marking slot to facilitate marking of proper placement of the gauge apparatus in relation to a horizontal position of at least one of the vanes.

12. The gauge apparatus according to claim 8, wherein the gauge apparatus comprises two alignment bendings to keep the gauge apparatus in a correct orientation at a front edge of a top track of a door operating assembly.

13. The gauge apparatus according to claim 8, wherein the gauge apparatus is made of a single metal plate with a pressing machine.

14. A gauge apparatus configured to assist in adjusting landing door rollers in an elevator, the elevator including an elevator car having a door operating assembly and a landing door coupler with vanes having counter surfaces, the gauge apparatus comprising:

at least two counter surfaces whose mutual horizontal distance is same as a mutual horizontal distance of the counter surfaces of the vanes of the landing door coupler at least during motion of the elevator car such that, a horizontal position of the counter surfaces of the vanes is copied upwards when the at least two counter surfaces of the gauge apparatus are aligned with the counter surfaces of the vanes while the gauge apparatus is on top of a top track of the door operating assembly.

15. The gauge apparatus according to claim 14, wherein the counter surfaces of the gauge apparatus are in tabs perpendicular to a plane of a bottom plate of the gauge apparatus, the tabs being an alignment aperture configured to adjust the landing door rollers in a depth direction of the elevator car.

16. The gauge apparatus according to claim 14, wherein the gauge apparatus is made of a single metal plate.

* * * * *